US010166766B2

(12) United States Patent
Masui

(10) Patent No.: US 10,166,766 B2
(45) Date of Patent: Jan. 1, 2019

(54) HEAD DRIVING DEVICE, LIQUID-EJECTION HEAD UNIT, AND LIQUID EJECTION APPARATUS

(71) Applicant: Naruhiro Masui, Kanagawa (JP)

(72) Inventor: Naruhiro Masui, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/448,046

(22) Filed: Mar. 2, 2017

(65) Prior Publication Data

US 2017/0253033 A1 Sep. 7, 2017

(30) Foreign Application Priority Data

Mar. 7, 2016 (JP) ..... 2016-043072
Jan. 18, 2017 (JP) ..... 2017-006722

(51) Int. Cl.
*B41J 29/38* (2006.01)
*B41J 2/045* (2006.01)

(52) U.S. Cl.
CPC ..... *B41J 2/04588* (2013.01); *B41J 2/04586* (2013.01)

(58) Field of Classification Search
None
See application file for complete search history.

(56) References Cited

U.S. PATENT DOCUMENTS 6,257,686 B1 7/2001 Takahashi et al.
7,249,816 B2 7/2007 Kusunoki et al.
8,322,814 B2 12/2012 Hirato et al.
8,757,750 B2 6/2014 Banerjee et al.
2001/0028370 A1 10/2001 Takahashi
2009/0244139 A1 10/2009 Takahashi
2014/0253620 A1* 9/2014 Watanabe ..... B41J 2/04588 347/11
2015/0328886 A1 11/2015 Masui

FOREIGN PATENT DOCUMENTS

EP 1 427 588 A1 6/2004
EP 2 308 683 A1 4/2011
JP 2001-301206 10/2001
JP 2009-241345 10/2009
JP 2015-231735 12/2015
WO WO 03/026897 A1 4/2003
WO WO 2011/112200 A1 9/2011

OTHER PUBLICATIONS

Extended European Search Report dated Jul. 25, 2017 in corresponding European Patent Application No. 17159234.8 (9 pages).

* cited by examiner

*Primary Examiner* — Matthew Luu
*Assistant Examiner* — Tracey McMillion
(74) *Attorney, Agent, or Firm* — Oblon, McClelland, Maier & Neustadt, L.L.P.

(57) ABSTRACT

A head driving device drives a liquid ejection head. The liquid ejection head includes a plurality of nozzles and a plurality of pressure generating devices provided respectively corresponding to the nozzles. The head driving device includes a driving-waveform correcting unit configured to correct driving waveform data that defines ejection characteristics of liquid to be ejected from the nozzle based on interference patterns expressing variations in the ejection characteristics caused by an interference occurring in the nozzle.

14 Claims, 9 Drawing Sheets

| | Dn(i) | Dn(i-1) | Dn(i-2) | Dn(i-3) |
|---|---|---|---|---|
| | E(i) | E(i-1) | E(i-2) | E(i-3) |
| FP1 | # | ≠0 | — | — |
| FP2 | # | 0 | ≠0 | — |
| FP3 | # | 0 | 0 | ≥2 |
| FP4 | # | 0 | 0 | 1 |
| : | | | | |

| | $D_{n-1}(i)$ | Dn(i) | $D_{n+1}(i)$ |
|---|---|---|---|
| | $E_{n-1}$ | En | $E_{n+1}$ |
| XP1 | 0 | # | 0 |
| XP2 | 0 | # | 1 |
| XP3 | 0 | # | 2 |
| XP4 | 0 | # | 3 |
| XP5 | 1,2 | # | 1,2 |
| XP6 | 3 | # | 3 |
| : | | | |

HEAD DRIVING DEVICE, LIQUID-EJECTION HEAD UNIT, AND LIQUID EJECTION APPARATUS

CROSS-REFERENCE TO RELATED APPLICATIONS

The present application claims priority under 35 U.S.C. § 119 to Japanese Patent Application No. 2016-043072, filed on Mar. 7, 2016 and Japanese Patent Application No. 2017-006722, filed on Jan. 18, 2017. The contents of which are incorporated herein by reference in their entirety.

BACKGROUND OF THE INVENTION

1. Field of the Invention

The present invention relates to a head driving device, a liquid-ejection head unit, and a liquid ejection apparatus.

2. Description of the Related Art

As an image forming apparatus, such as a printer, a facsimile, a copier, and a digital printing device, a liquid-ejection-recording image forming apparatus (for example, an inkjet recording apparatus) that uses a recording head constituted, for example, of a liquid ejection head (ink-droplet ejection head) that ejects in droplets has been known. This liquid-ejection-recording image forming apparatus forms a desired image by ejecting ink droplets from the recording head onto a recording medium (for example, a paper sheet).

The recording head is equipped with a nozzle that ejects ink droplets, an ink passage (pressure chamber) with which the nozzle communicates, and a pressure generating unit that applies pressure to ink inside the ink passage, and generally, a so-called piezoelectric type in which a piezoelectric device is used as a pressure generating unit, and by micro-vibrating a vibrating plate that forms a wall of the ink passage by the piezoelectric device, the volume inside the ink passage is changed to eject ink droplets; a so-called thermal type in which ink droplets are ejected by pressure caused by bubbles generated by heating ink inside the ink passage by using a heat element; and an electrostatic type in which a vibrating plate that forms a wall of the ink passage and an electrode are arranged opposing to each other, and by deforming the vibrating plate by static electricity generated between the vibrating plate and the electrode, the volume inside the ink passage is changed to eject ink droplets have been known.

It is explained with the piezoelectric type as an example. Multiple nozzles are formed in a recording head, and an ink passage (pressure chamber) and a pressure generating unit (the pressure generating unit is explained with an example of a piezoelectric member (piezoelectric device)) are provided for each nozzle. These nozzles are arranged in a predetermined direction (hereinafter, this direction is referred to as nozzle row direction).

All of the piezoelectric members are electrically connected in parallel between a common electric supply line and a ground wiring, and to each of the piezoelectric members, a switching device is electrically connected in series. A signal (driving waveform) is generated by a driving-waveform generating circuit, and is selectively distributed to the respective piezoelectric members through the power supply line and the switching device. That is, when a specific switching device is selected to be on based on print data, a driving waveform is applied to the piezoelectric member through the power supply line, and ink droplets are ejected from a specific nozzle corresponding to the piezoelectric member to which the driving waveform has been applied.

Moreover, there also is a recording head that ejects various kinds of ink droplets (for example, a large droplet, a medium droplet, and a small droplet) having different ink volumes to improve the gradation of an image by changing the size of dots that are formed on a recording medium. In such a recording head, ink droplets are successively ejected while changing the drop speed by using a driving waveform having multiple pulse trains within a printing cycle, and the driving waveform is configured so that the droplets coalesce into one droplet in the air. In this case, a common driving-circuit method in which one common driving waveform having various driving waveform elements to eject various kinds of ink droplets combined is used, and a necessary part of waveform is selectively applied to respective piezoelectric members by a switching device is generally used.

Furthermore, generally, this driving waveform requires a waveform of a comparatively large voltage amplitude such as 20 volts (V) to 40 V, and a driving-waveform generating circuit to generate and drive such a waveform is comparatively large scale, and the consumed power is also large. Therefore, it is not arranged in a recording head that is required to be in a small size, and a driving waveform that is generated by another circuit board is often provided to the recording head through a power supply line. Moreover, a switching device that is provided for each piezoelectric member is often integrated with a control unit that generates an on/off selection signal and arranged close to the piezoelectric member in the recording head.

This integrated switching device includes a transistor, and uses a high-voltage power metal oxide semiconductor field-effect transistor (MOSFET) and the like to drive a relatively large voltage amplitude is used, to be a large size. Therefore, the ratio to the size of the integrated circuit is also large.

To form a high-quality image in an inkjet recording apparatus, it is demanded to put a desired amount of ink droplet at a desired position on a recording medium. Therefore, a driving waveform provided to a piezoelectric member is appropriately configured considering the ink drop speed, the stability in the ejection state (curved ejection, satellite, a mist generating state), and the like.

As a technique of correcting variations in the droplet amount and in a landing position of ejected liquid, and of forming a high-quality image, for example, a technique disclosed in Japanese Unexamined Patent Application Publication No. 2001-301206 (Patent Literature 1), or in Japanese Unexamined Patent Application Publication No. 2009-241345 (Patent Literature 2) is publicly known.

In Patent Literature 1, it is described that to prevent instability of ejection and a change in an ink droplet volume caused by meniscus vibration of residual ink from previous ejection (hereinafter, "residual vibration"), a driving waveform of a dot is changed based on whether ejection is performed right before and right after the dot, and on a shape of the driving waveform of an ejection pulse signal.

Furthermore, in Patent Literature 2, it is described that considering not only an influence of ejection before and after, but also an influence caused by crosstalk in which energies generated at the time of ejection from adjacent nozzles propagate mutually, a type of ink droplet at the time of an arbitrary ejection timing of each nozzle is determined referring to an ejection history of the nozzle included in chronological information, and a type of ink droplet that is associated with an arbitrary ejection timing of a nozzle other than the nozzle.

However, in the techniques disclosed in Patent Literatures 1 and 2, changeable driving waveforms have increased by only one or more, and the accuracy has not been sufficiently high to correct the ejection speed and the ejection droplet amount, and to cause a desired droplet amount of ink to land at a desired position. Inversely, to make the correction accuracy sufficiently high, it is necessary to generate more driving waveforms, and to select a driving waveform from among them according to previous and next waveforms. As a result, the driving-waveform generating circuit becomes a large scale, to cause an increase in the number of driving-waveform signal lines to transmit to a head, and an increase of driver circuits that perform selection of a driving waveform. Such an increase causes an increase in the size of the apparatus and cost.

Moreover, if the processing speed is improved to be high, the residual vibration of not only ejection right before the dot but also of ejections of several dots prior to that can affect it. Therefore, to perform ejection with sufficient accuracy, enormous amounts of driving waveforms are required to be generated, and it is difficult in an actual situation. On the other hand, if the number of driving waveforms is decreased to the realistic number, the correction accuracy is to be not sufficiently high, and it is not sufficient to improve the image quality.

In the following explanation, phenomena of variations in the ejection speed and the ejection droplet amount, and instability of ejection caused by previous ejection are referred to as "temporal interference", and phenomena of variations in the ejection speed and the ejection droplet amount, and instability of ejection caused by ejection from an adjacent nozzle is referred to as "spatial interference" appropriately.

In either case, it has been difficult to correct the variation in the ejection speed and the ejection droplet amount, and to cause a desired droplet amount of liquid to land at a desired position with high accuracy.

SUMMARY OF THE INVENTION

According to one aspect of the present invention, a head driving device drives a liquid ejection head. The liquid ejection head includes a plurality of nozzles and a plurality of pressure generating devices provided respectively corresponding to the nozzles. The head driving device includes a driving-waveform correcting unit configured to correct driving waveform data that defines ejection characteristics of liquid to be ejected from the nozzle based on interference patterns expressing variations in the ejection characteristics caused by an interference occurring in the nozzle.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
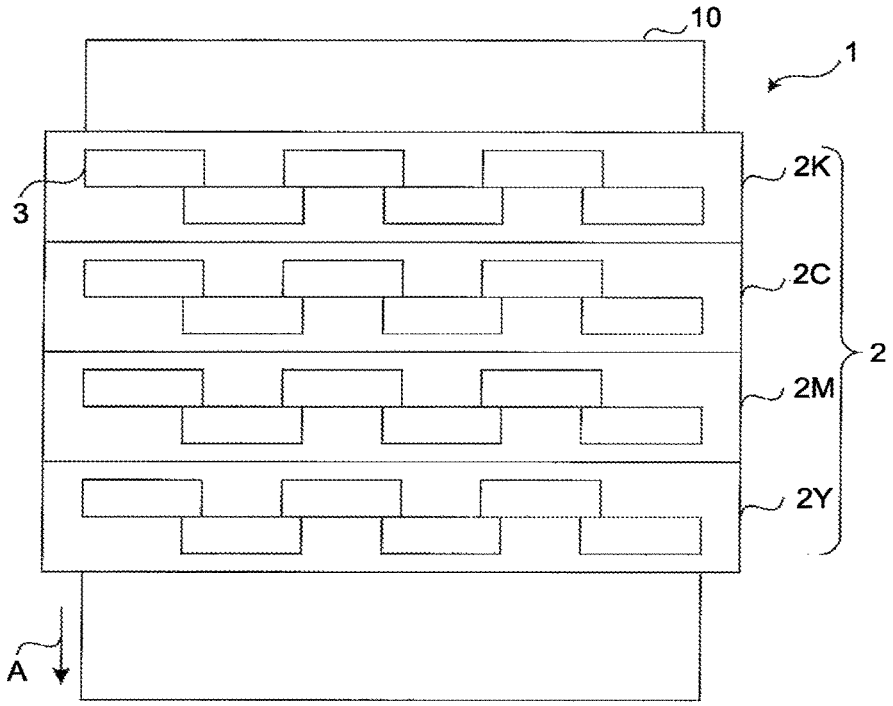
FIG. 1 illustrates a schematic configuration of an image forming apparatus according to a first example of an embodiment of the present invention.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

An object of an embodiment is to correct a variation in a droplet amount and/or a variation in a landing position of ejected liquid caused by an influence of a temporal interference and/or a spatial interference with high accuracy, and to suppress degradation of an image quality.

In the present invention, there are provided multiple driving-waveform generating units respectively corresponding to multiple nozzles, and correction data of a driving waveform is generated to correct variations of ejection characteristics (at least one of an ink droplet amount and an landing position) caused by influence of an interference. Moreover, in the present invention, the corresponding waveform-generating unit generates a driving waveform corrected according to the correction data.

An embodiment of the present invention is explained in detail below with examples, referring to the drawings.

FIG. 1 illustrates a schematic configuration of an image forming apparatus according to one example of the present embodiment (hereinafter, "first example").

The image forming apparatus according to the first example is an image forming apparatus that uses a liquid ejection head that ejects, or jets liquid from a nozzle, as a recording head. More specifically, it is a line-scanning inkjet recording apparatus that adopts an inkjet head as the liquid ejection head.

The liquid ejection head is a functional component that ejects or jets liquid from a nozzle. The liquid to be ejected is not particularly limited as long as it has a viscosity and a surface tension enabling ejection from a head, but it is preferable to have a viscosity equal to or lower than a predetermined value (for example, 30 millipascal second (mPa·s)) according to the head at room temperature and atmospheric pressure, or by being heated or cooled. An example of an ejected liquid is a solution, a suspension, and an emulsion including a solvent such as water and organic solvent, a coloring agent such as dye and pigment, a functionality imparter such as a polymerizable compound, a resin, and a surface-active agent, a biocompatible material such as deoxyribonucleic acid (DNA), amino acid, protein, and calcium, an edible material such as natural coloring matter, and the like. These can be used, for example, as an inkjet ink, a surface treatment solution, a liquid for forming a component of an electronic device and a light emitting device, and a resist pattern, a material solution for three-dimensional molding, and the like.

A source of an energy to eject liquid can be one that uses a piezoelectric actuator (a stacked piezoelectric element and a thin film piezoelectric element), a thermal actuator that uses an electric thermal conversion element such as a heat element, an electrostatic actuator that includes a vibrating plate and a counter electrode, and the like. In the present embodiment, an example using a stacked piezoelectric element is given.

FIG. 1 is a plan view of an image forming apparatus (inkjet recording apparatus) 1 according to the first example viewed from above a recording medium 10 in a vertical direction.

The recording medium 10 is, for example, a paper sheet, and its form can be of any, such as a roll sheet (continuous roll paper) or a cut sheet. It can also be various kinds of media other than paper sheet. The recording medium 10 is conveyed in a predetermined direction (direction of an arrow A in FIG. 1). A recording unit 2 is held opposing to a surface of this recording medium 10 to be recorded, maintaining a predetermined distance from each other. The recording unit 2 includes a K-recording unit 2K, a C-recording unit 2C, an M-recording unit 2M, and a Y-recording unit 2Y that are provided corresponding to respective inks of black (K), cyan (C), magenta (M), and yellow (Y). The recording unit 2 ejects ink droplets synchronizing with a sheet conveying speed, thereby forming a color image on the recording medium 10.

Although a mechanism to control conveyance such that the recording medium 10 passes at a predetermined speed, through a predetermined position relative to the recording unit 2 is provided in the image forming apparatus 1 as a matter of course, the present invention does not feature the conveyance mechanism. As a publicly-known mechanism as a line printer can be applied, illustration and explanation of a part not directly related to the gist of the present invention are omitted herein.

Each of the K-recording unit 2K, the C-recording unit 2C, the M-recording unit 2M, and the Y-recording unit 2Y is configured with multiple liquid ejection heads 3 aligned in a row, or in a staggered arrangement as illustrated, in a direction perpendicular to a conveying direction. By thus arranging the liquid ejection heads 3 in an array, a wider width of a print area is obtained.

Figure 2:
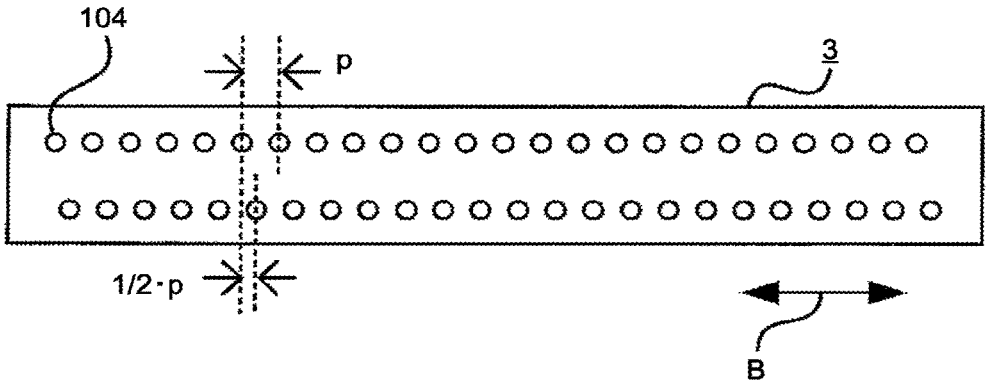
FIG. 2 illustrates one example of a liquid ejection head.

FIG. 2 illustrates one example of the liquid ejection head 3. The liquid ejection head 3 includes plural nozzles 104 arranged in a direction perpendicular to the sheet conveying direction (direction of arrow A) (hereinafter, "nozzle row direction" as appropriate: direction of arrow B) at predetermined pitches p. In the liquid ejection head 3 illustrated in FIG. 2, two rows of the nozzle row are arranged, and the respective nozzles are shifted by approximately ½·p in the nozzle row direction, so as to enable recording at a high resolution in the nozzle row direction.

Figure 3:
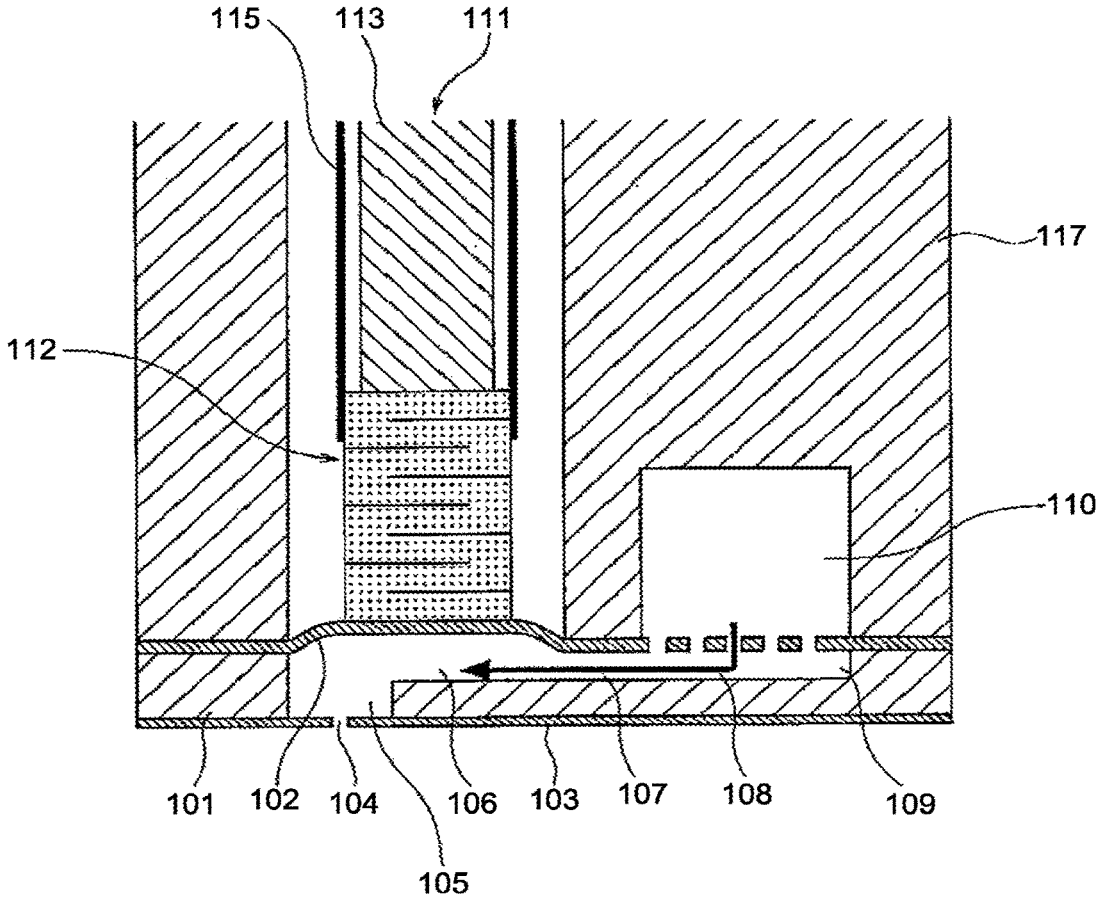
FIG. 3 illustrates an essential portion of the liquid ejection head on a cross-section along a longitudinal direction of a liquid chamber, and illustrates a state at the time of suction of liquid.
Figure 4:
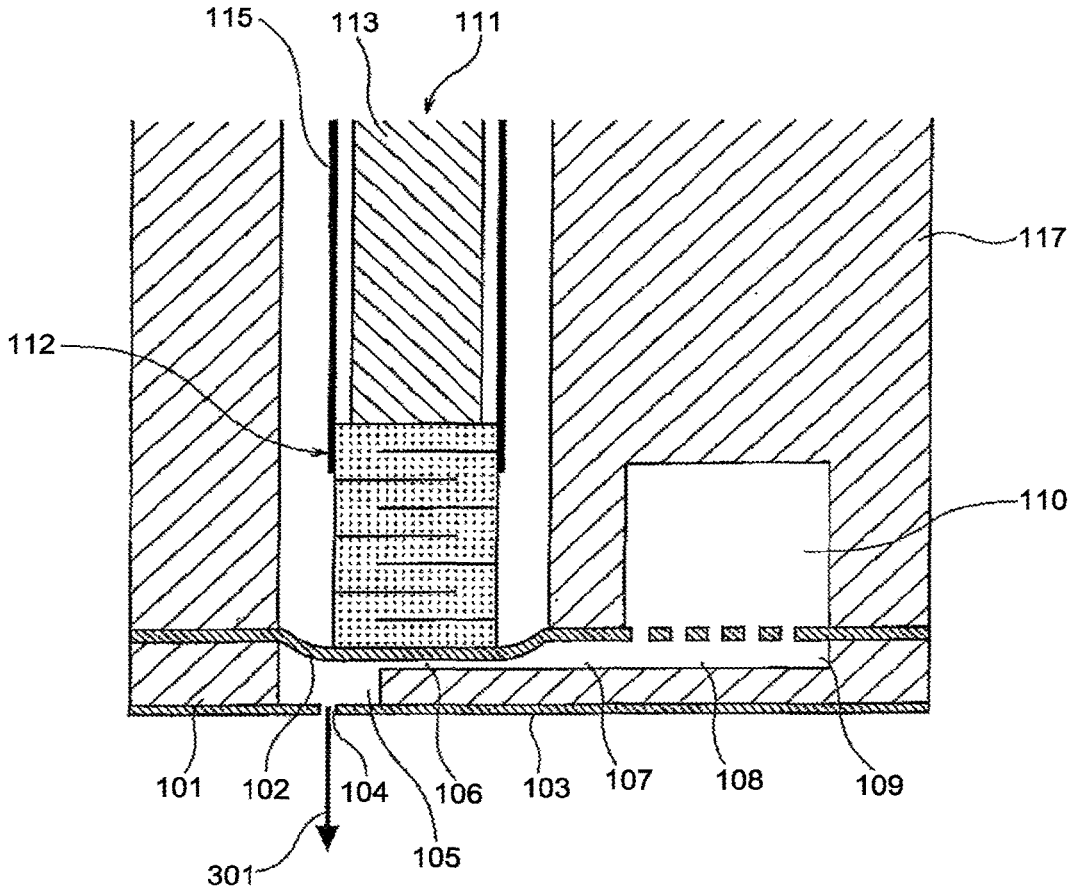
FIG. 4 illustrates the essential portion of the liquid ejection head on a cross section along the longitudinal direction of the liquid chamber, and illustrates a state at the time of ejection of liquid.

FIG. 3 and FIG. 4 illustrate an essential portion of the liquid ejection head 3 on a cross-section along a longitudinal direction of a liquid chamber (direction perpendicular to the nozzle row direction).

The liquid ejection head 3 includes a through hole 105, an independent liquid chamber 106, a fluid resistance portion 107, a liquid introducing portion 108, and a common liquid chamber 110, and ejects liquid from the nozzle 104 that is formed on a nozzle plate 103 arranged on a liquid ejection side of the through hole 105. On the opposite side to the nozzle plate 103 of the through hole 105, a vibrating plate member 102 is provided. The nozzle 104 connects a passage plate 101, the vibrating plate member 102, and the nozzle plate 103, and communicates to the independent liquid chamber 106 through the through hole 105. As the independent liquid chamber 106 is also referred to as a pressurizing chamber, a pressurizing liquid chamber, a pressure chamber, an independent passage, a pressure generating chamber, and the like, it is hereinafter simply referred to as "liquid chamber".

A liquid (ink) is introduced from the common liquid chamber 110 formed in a frame member 117 to the liquid introducing portion 108 through a filter 109 formed in the vibrating plate member 102, and is supplied from the liquid introducing portion 108 to the liquid chamber 106 through the fluid resistance portion 107.

The passage plate 101 is formed by layering metallic plates of steel use stainless (SUS) or the like, and forms openings and channels of the through hole 105, the liquid chamber 106, the fluid resistance portion 107, the liquid introducing portion 108, and the like.

The vibrating plate member 102 is a wall member that forms a wall surface of the liquid chamber 106, the fluid resistance portion 107, the liquid introducing portion 108, and the like, and is a member that forms a portion corresponding to the filter 109. The passage plate 101 is not limited to be formed with a metallic plate of SUS and the like, but can be formed also by anisotropic etching a silicon substrate.

On a surface opposite to the liquid chamber 106 of the vibrating plate member 102, a layered piezoelectric member 112 that causes liquid droplet to be ejected from the nozzle 104 by pressurizing the ink in the liquid chamber 106 is connected. This layered piezoelectric member (hereinafter, also referred to simply as "piezoelectric member") 112 is a driving device (an actuator unit, a pressure generating unit, a pressure generating device) that generates energy, and is configured as a columnar electric machine-conversion element in the first example. One end of this piezoelectric member 112 is connected to a base member 113. Moreover, to the piezoelectric member 112, a flexible printed circuit (FPC) board 115 that transmits a driving waveform is connected. These constitute a piezoelectric actuator 111.

Although in the first example, the piezoelectric member 112 is used in a d33 mode of expanding in a layered direction, it can be used in a d31 mode of expanding in a direction perpendicular to the layered direction.

In the liquid ejection head 3 configured as above, for example, as illustrated in FIG. 3, by reducing a voltage to be applied to the piezoelectric member 112 from a reference potential Ve, the piezoelectric member 112 contracts to deform the vibrating plate member 102, and the volume of the liquid chamber 106 increases. As a result, the liquid (ink) flows into the liquid chamber 106. Thereafter, as illustrated in FIG. 4, by increasing the voltage to be applied to the piezoelectric member 112, to make the piezoelectric member 112 expand in the layered direction. Thus, the vibrating plate member 102 deforms in the direction of the nozzle 104, to decrease the volume of the liquid chamber 106. As a result, the ink in the liquid chamber 106 is pressurized, and a liquid droplet 301 is ejected from the nozzle 104.

Furthermore, by returning the voltage to be applied to the piezoelectric member 112 to the reference potential Ve, the vibrating plate member 102 returns to an initial position, to expand the liquid chamber 106, thereby generating a negative pressure. By this negative pressure, ink is filled in the liquid chamber 106 from the common liquid chamber 110. This filling of ink is referred to as refilling.

After attenuation of vibration of the meniscus surface of the nozzle 104 stabilizes, the operation is shifted to that for next liquid droplet ejection. However, in recent years, a print driving frequency has been high to increase the print speed, next liquid droplet ejection can be started before the vibration on the meniscus surface attenuates. If next liquid droplet ejection starts before the attenuation, the meniscus position at the start of ejection changes, and therefore, a phenomenon that an ejection speed and an ejection droplet amount change, or that ejection becomes unstable occurs. Particularly, vibration by refilling often becomes a long period motion, and not only residual vibration of ejection right before that but also of ejection further before can often influence. This is the temporal interference described above.

Moreover, the nozzles 104 are aligned in a direction perpendicular to a paper surface in FIG. 3 at intervals of the pitch p. The passage plate 101, the vibrating plate member 102, and the nozzle plate 103 forming the liquid chamber 106 are formed into one piece with those of the adjacent nozzle, and when ejection is performed by the adjacent nozzle, vibration and deformation of the respective parts thereof can exert an influence on ejection of the nozzle. This influence is to change an ejection speed and an ejection droplet amount, or to make the ejection speed and the ejection droplet amount unstable. Furthermore, vibration of a separation wall that separates each nozzle can exert an influence. This is called crosstalk generally. Particularly, when the pitch p is decreased for higher density arrangement to achieve both the miniaturization of the head and high resolution, the influence of the crosstalk increases. This is the spatial interference described above.

The liquid droplet 301 ejected from the nozzle 104 lands on a recording medium that is held maintaining a predetermined distance L after a predetermined traveling time Ti. When an ejection speed of the liquid droplet 301 is vi, the traveling time Ti is "Ti=L/Vi". This ejection speed Vi can vary affected by the temporal interference and the spatial interference, and as a result, the traveling time Ti can vary. The recording medium is being conveyed at a constant speed. Therefore, the landing position in the conveying direction can vary. Furthermore, the ejected droplet amount can also vary.

Figure 5:
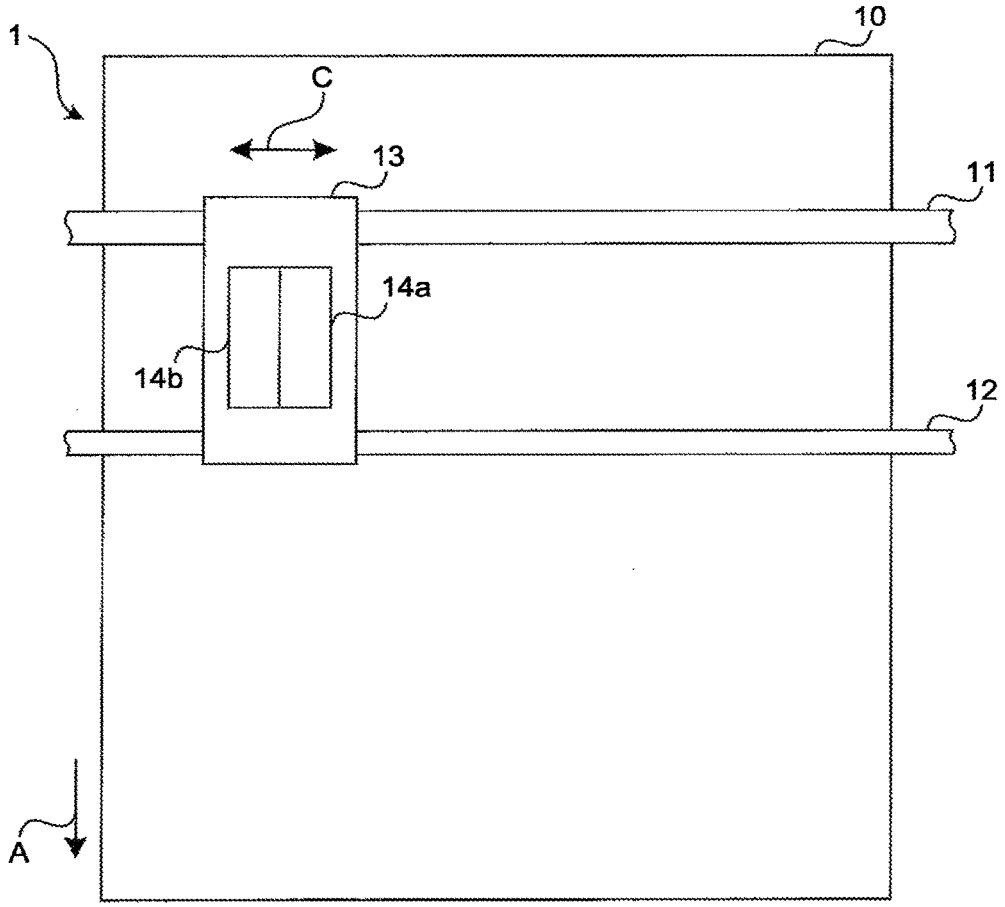
FIG. 5 illustrates a schematic configuration of an image forming apparatus according to a second example of the embodiment of the present invention.

FIG. 5 illustrates a schematic configuration of an image forming apparatus of another example (hereinafter, "second example") of the present embodiment.

The image forming apparatus according to the second example is an image forming apparatus that uses a liquid ejection head that ejects or jets from a nozzle as a recording head, similarly to the first example. More specifically, it is a serial inkjet recording apparatus that adopts an inkjet head as the liquid ejection head. It differs from the first example being of the line type in being of the serial type.

FIG. 5 is a plan view of the image forming apparatus 1 according to the second example from above the recording medium 10 in a vertical direction. The image forming apparatus 1 according to the second example includes main and sub guide rods 11 and 12 that are guide members supported horizontally on right and left side plates of an apparatus main unit. A carriage 13 of the image forming apparatus 1 is held slidably in a direction (main scanning direction) perpendicular to a conveying direction A of the recording medium 10 by the guide rods 11 and 12. The carriage 13 moves and scans in a direction of an arrow C in FIG. 5 (carriage scanning direction) by a main scanning motor through a timing belt. In the carriage 13, a first liquid-ejection head 14*a* and a second liquid-ejection head 14*b* to eject liquid droplets of respective colors of yellow (Y), cyan (C), magenta (M), and black (K) are arranged such that the nozzle row is perpendicular to the main scanning direction. Furthermore, the first liquid-ejection head 14*a* and the second liquid-ejection head 14*b* are installed such that an ink-droplet ejection direction directs downward. In the following, when the first liquid-ejection head 14*a* and the second liquid-ejection head 14*b* are not distinguished from each other, the both thereof are called liquid ejection head 14 collectively.

Each of the liquid ejection heads 14 has two nozzle rows, and one nozzle row of the first liquid-ejection head 14*a* ejects liquid droplets of black (K), and the other nozzle row ejects liquid droplets of cyan (C). Moreover, one nozzle row of the second liquid-ejection head 14*b* ejects liquid droplets of magenta (M), and the other nozzle row ejects liquid droplets of yellow (Y).

An operation of ejecting ink droplets onto the recording medium 10 in a still state to perform recording corresponding to one scanning by driving the liquid ejection head 14 in the main scanning direction according to an image signal while moving the carriage 13, and of performing next recording after the recording medium 10 is conveyed by a predetermined amount is repeated. Note that the mechanism of the liquid ejection head 14 is the same as the configuration illustrated in FIG. 3 and FIG. 4 in the first example.

Figure 12:
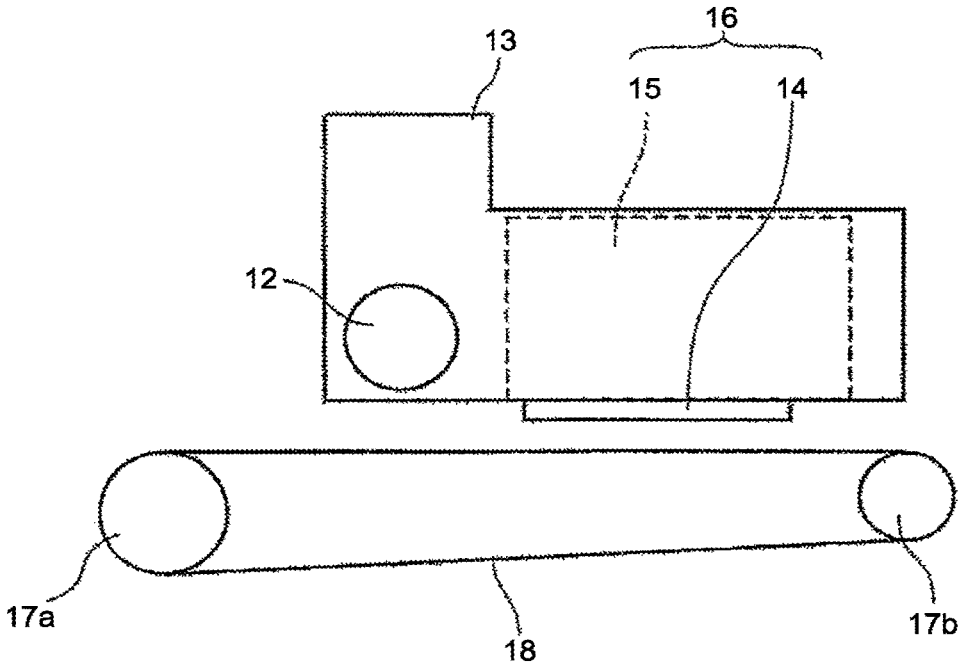
FIG. 12 illustrates a reference example of the liquid ejection head and a liquid ejection unit that replenishes liquid to the head.

Moreover, in the carriage 13, a liquid ejection unit 16 integrated with a head tank 15 as illustrated in FIG. 12 described later is mounted, with respect to the first liquid-ejection head 14*a* and the second liquid-ejection head 14*b*. The liquid ejection head 14 of the liquid ejection unit 16 ejects liquid of respective colors of, for example, yellow (Y), cyan (C), magenta (M), and black (K) as described above.

Furthermore, terms, image forming and recording in the present application are synonyms, and terms, writing, copying, printing, forming, and the like are also synonyms.

Note that similarly to the first example, illustration and explanation of parts that are not directly related to the gist of the present invention are omitted herein.

Figure 6:
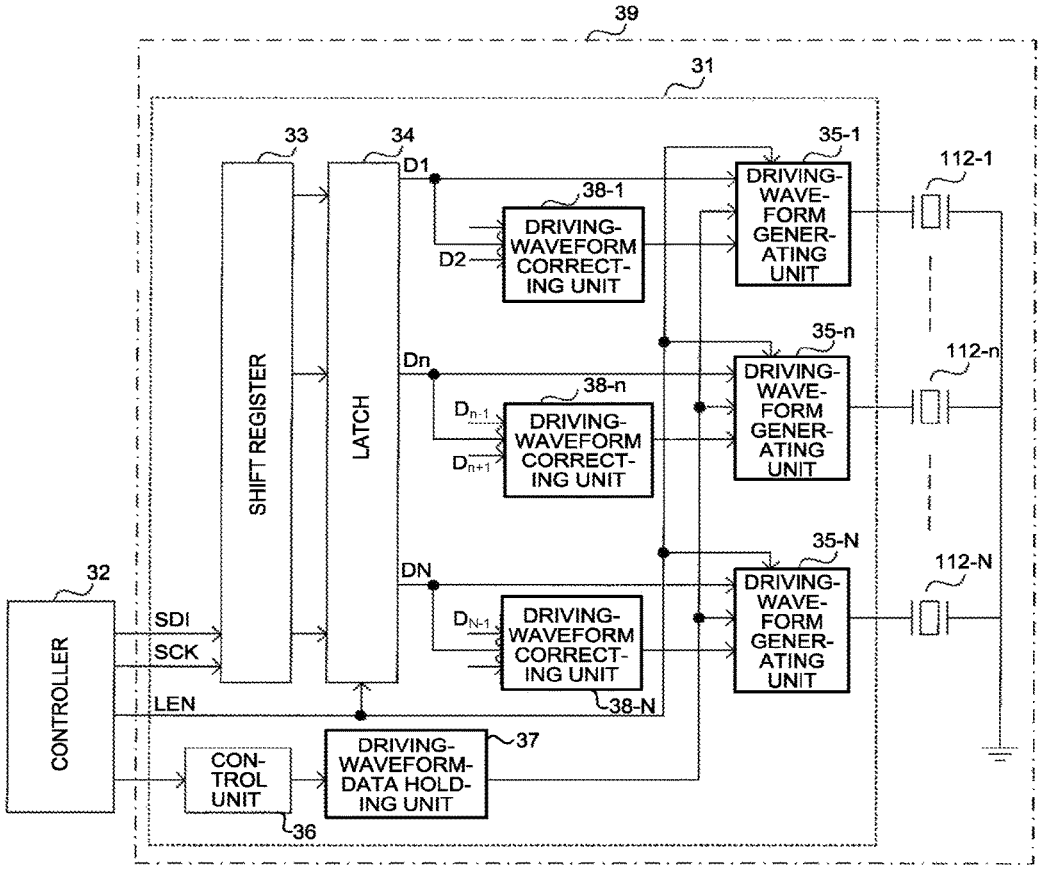
FIG. 6 is a block diagram illustrating a configuration of a head driving unit to drive the liquid ejection head in the first and the second examples.

FIG. 6 is a block diagram illustrating a configuration of a head driving unit as a head driving device to drive the liquid ejection heads 3 and 14 in the first and the second examples.

As illustrated in FIG. 6, a head driving unit 31 drives N pieces of piezoelectric members 112-1 to N according to an instruction from a controller 32. By driving the piezoelectric members 112-1 to N, liquid (liquid droplets) is ejected from N pieces of nozzles provided in the liquid ejection heads 3 and 14. This head driving unit 31 drives the piezoelectric members for one nozzle row in the liquid ejection heads 3 and 14. For example, in the image forming apparatus 1 of the first example illustrated in FIG. 1, the head driving unit 31 is provided for each nozzle row for each of the liquid ejection heads 3. When the N pieces of the piezoelectric members are not distinguished from each other and called collectively, they are called piezoelectric member 112.

In the piezoelectric member 112, one electrode is connected to a common potential (for example, ground) together with other piezoelectric members through the FPC board 115 that transmits a driving waveform, and the other electrode is connected to the head driving units 31, respectively.

The head driving unit 31 includes one or more integrated circuits, and at least a portion connected to the piezoelectric member 112 out of those is arranged on the FPC board 115. Based on data transferred from the controller 32, an optimal driving waveform is generated for each of the piezoelectric members 112 so that ejection is performed from each nozzle appropriately, and to drive the piezoelectric members 112. In the present embodiment, the head driving unit 31 and the piezoelectric member 112 constitutes a liquid-ejection head unit 39.

The head driving unit 31 can be integrated with the liquid ejection head 3. By integrating into one piece, the recording head unit of the present invention can be formed.

The controller 32 separates image data to be printed into pieces of image data corresponding to the respective recording heads and nozzle rows, and transfers them to the head driving unit 31. Moreover, the controller 32 has a function of transferring and setting driving waveform data, correction data, and the like that are used when the head driving unit 31 generates a driving waveform, and a function of providing various kinds of control signals.

In the following, a detailed configuration of the head driving unit 31 is explained.

The head driving unit 31 includes a shift register 33, a latch 34, driving-waveform generating units 35 (35-1 to 35-N), a control unit 36, a driving-waveform-data holding unit 37, and driving-waveform correcting units 38 (38-1 to 38-N). N pieces of image data corresponding to data of one line of the liquid ejection head 3 are input from the controller 32 to the head driving unit 31 in series, synchronizing with a transfer clock SCK. The N pieces of image data input in series are sequentially stored in the shift register 33. When liquid droplets (ink droplets) corresponding to dots in different sizes of four values, for example, a large droplet, a medium droplet, a small droplet, and no ejection are ejected from the nozzle of the liquid ejection head 3, one piece of image data is 2-bit data.

The latch 34 is N pieces of latches that hold the N pieces of image data held once in the shift register 33, in response to an input of a latch enable signal LEN, and each latch holds 2-bit data (D1 to DN) and provides the data to the corresponding driving-waveform generating unit 35.

The driving-waveform generating units 35-1 to 35-N generate driving waveforms to drive the N pieces of the piezoelectric members 112-1 to 112-N independently. The driving-waveform generating unit 35-1 to 35-N are provided respectively corresponding to the piezoelectric members 112-1 to N. The driving-waveform generating unit 35-*n*, which is the n-th (n is 1 to N: positive integer) channel, refers to 2-bit image data Dn that is provided from the latch 34 in synchronization with the latch enable signal LEN. Furthermore, the driving-waveform generating unit 35-*n* refers to the driving waveform data that is held in the driving-waveform-data holding unit 37 according to the image data Dn. The driving-waveform generating unit 35-*n* refers to the correction data of the driving waveform that is provided from the driving-waveform correcting unit 38-*n*, and by referring to these, generates a driving waveform based on the latch enable signal LEN as a start reference, and provides it to the piezoelectric member 112-*n*. Note that referring to the driving waveform data held in the driving-waveform-data holding unit 37 according to the image data Dn means referring to driving waveform data for a large droplet, for example, when the image data Dn is data indicating the large droplet.

The driving-waveform-data holding unit 37 stores data of a driving waveform as, for example, a driving waveform per dot in different sizes of, for example, a large droplet, a medium droplet, a small droplet, and no ejection. Details of this data are described later.

The driving-waveform correcting units 38-1 to 38-N generate pieces of correction data to correct driving waveforms so as to suppress variations in ejection characteristics (the ejection speed, the ink droplet amount, the ejection stability, and the like) that vary, affected by the temporal interference and the spatial interference described above. The driving-waveform correcting units 38-1 to 38-N are provided respectively corresponding to the piezoelectric members 112-1 to 112-N. The driving-waveform correcting unit 38-*n*, which is the n-th channel, receives the 2-bit image data Dn, and image data Dn−1 and image data Dn+1 of adjacent channels that are provided in synchronization with the latch enable signal LEN from the latch 34, and generates correction data. The driving-waveform correcting unit 38-*n* provides the data to the corresponding driving-waveform generating unit 35-*n*. Although one piece each of image data adjacent to the image data Dn on both sides, namely, the image data Dn−1 and Dn+1, are input in this example, more than one piece of image data on both sides can be input.

The control unit 36 performs overall control of the head driving unit 31. Furthermore, the control unit 36 has a function of performing communication with the controller 32, and sets data to be held, for example, in the driving-waveform-data holding unit 37 or the driving-waveform correcting unit 38, or updates the data.

Figure 7:
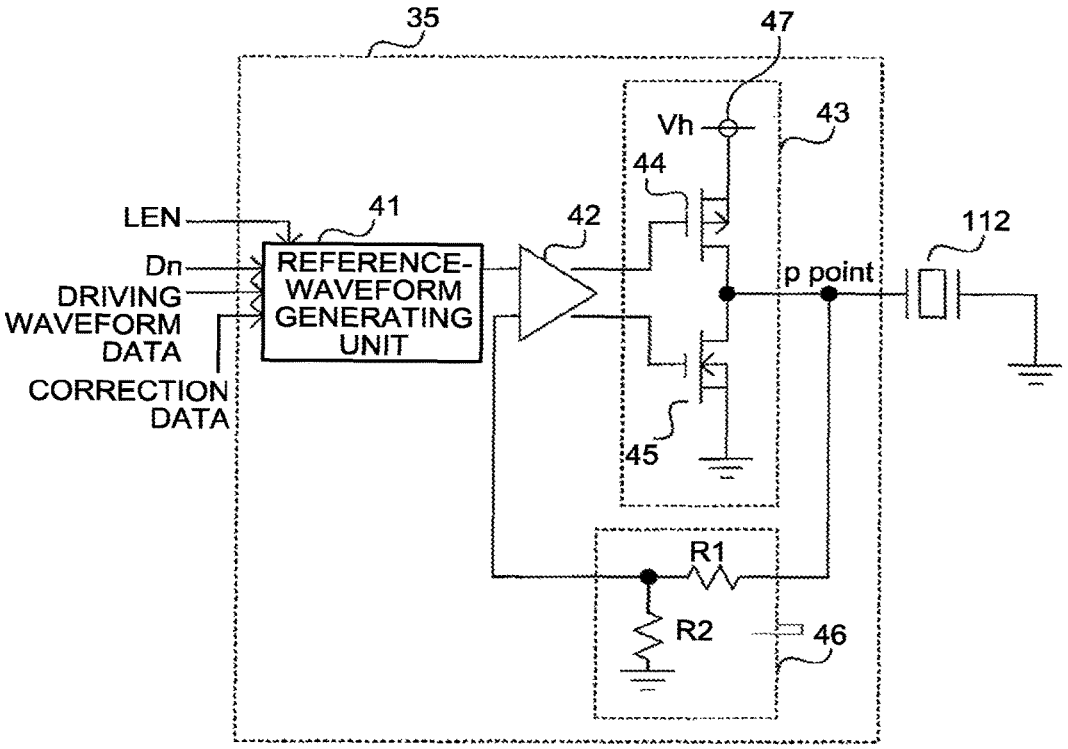
FIG. 7 is a block diagram illustrating a configuration of a driving-waveform generating unit.

FIG. 7 is a block diagram illustrating a configuration of the driving-waveform generating unit 35.

The driving-waveform generating unit 35 includes a reference-waveform generating unit 41, a control amplifier 42, a driver unit 43, and an attenuator 46, as illustrated in FIG. 7.

The reference-waveform generating unit 41 generates a waveform that is contracted to 1/A (A>1) of a desired driving waveform from the image data Dn, the driving waveform data, the correction data, and the latch enable signal LEN as a waveform-generation start reference, as a reference waveform. For example, it includes a digital-to-analog (DA) converter, and the like, and generates input data to the DA converter from the driving waveform data and the correction data.

The control amplifier 42 compares the reference waveform, which is 1/A of the desired driving waveform output by the reference-waveform generating unit 41, with a waveform that is obtained by reducing a driving voltage applied to one end of the piezoelectric member 112 to 1/A by the attenuator 46. The control amplifier 42 provides a charging/discharging signal to the driver unit 43 such that these become consistent.

The driver unit 43 performs charge and discharge on the piezoelectric member 112 according to the charging/discharging signal output by the control amplifier 42, and drives the piezoelectric member 112 such that a desired driving waveform is applied. The driver unit 43 includes a p-ch metal oxide semiconductor (MOS) 44 that is connected to a power source 47 having a voltage value Vh and one end point p of the piezoelectric member 112, and an n-ch MOS transistor 45 that is connected to the one end point p of the piezoelectric member 112 and a ground, and controls a charge current and a discharge current by controlling a gate voltage of the respective MOS transistors according to the charging/discharging signal, to drive such that the point p has a desired waveform.

The attenuator 46 attenuates a driving waveform that is being applied to the piezoelectric member 112 to 1/A.

For example, the attenuator 46 includes a resistance voltage divider as illustrated, and when resistance values are R1 and R2, a resistance value is selected so that "R2/(R1+R2)=1/A" is obtained. Furthermore, the attenuator 46 is configured so that a current that flows into the attenuator 46 is sufficiently small compared to the charge and discharge currents of the piezoelectric member 112.

As described, as the charging and discharging are controlled such that a driving waveform applied to the piezoelectric member 112 always matches with a desired waveform, a desired waveform can be applied to the piezoelectric member 112 accurately, and a desired ejection characteristics can be obtained.

In the driving-waveform generating unit 35, a circuit that is configured with a high voltage process and that is connected to the power source 47 to operate is only the driver unit 43. As the components other than driver unit 43 can be configured with a low voltage process, even if there are provided the plurality of driving-waveform generating units 35 for the respective nozzles, it is implementable as an integrated circuit with a sufficient chip size to be arranged in the liquid ejection heads 3 and 14. Originally, also in the conventional liquid ejection heads 3 and 14, at least one pair of bidirectional switching devices is provided for each of the piezoelectric members 112. As the direction of a current that flows into the bidirectional switching device is bidirectional, it is generally configured with at least two high voltage process transistors. That is, even if multiple driving-waveform generating units corresponding to the respective piezoelectric members are provided as in the present embodiment, a region configured with a high voltage process does not significantly change, or can be smaller. Therefore, it does not cause increase in size of the apparatus, increase in consumed power, or increase in cost. Note that if it is configured to select from among plural driving signals, plural switching devices are provided.

Figures 8, 9A, 9B:
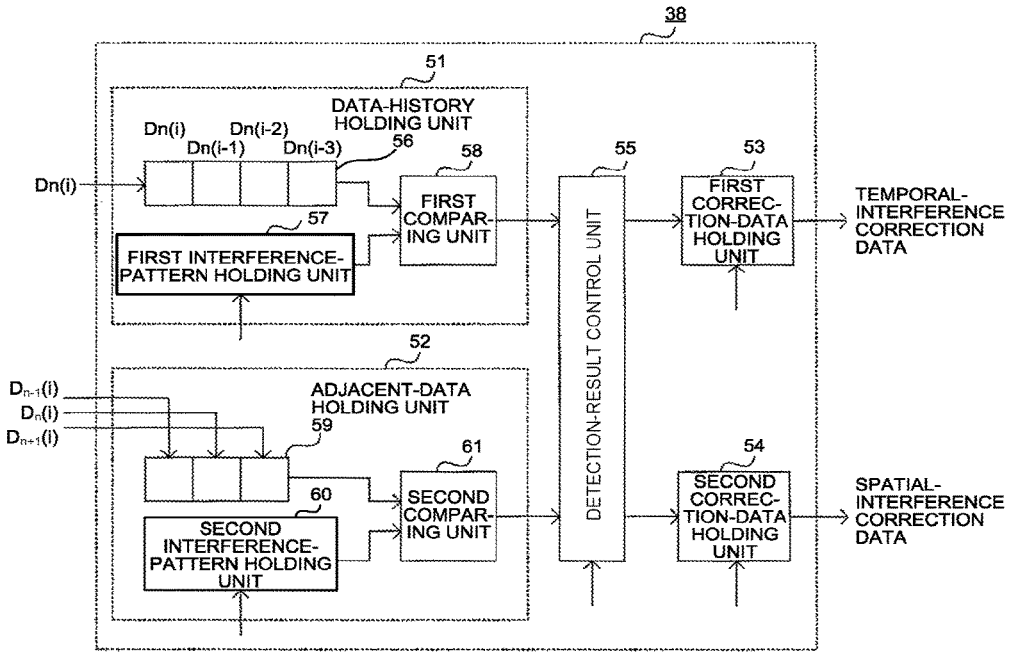
FIG. 8 is a block diagram illustrating a configuration of a correction-data generating unit.
FIG. 9A illustrates interference patterns that are held in the first interference-pattern holding unit.
FIG. 9B illustrates interference patterns that are held in the second interference-pattern holding unit.

FIG. 8 is a block diagram illustrating a configuration of the driving-waveform correcting unit 38.

The driving-waveform correcting unit 38 includes a first detecting unit 51, a second detecting unit 52, a first correction-data holding unit 53, a second correction-data holding unit 54, and a detection-result control unit 55.

The first detecting unit 51 receives the image data Dn of the channel n, and detects a temporal interference. The first detecting unit 51 includes a data-history holding unit 56, a first interference-pattern holding unit 57, and a first comparing unit 58. Image data Dn(i) indicates image data that corresponds to ejection in i-th cycle relative to the latch enable signal LEN.

The data-history holding unit 56 includes, for example, a shift register, and holds a history up to data Dn(i−3), which is data of three cycles before, including data of the cycle.

FIG. 9A illustrates interference patterns that are held in the first interference-pattern holding unit, and FIG. 9B illustrates interference patterns that are held in the second interference-pattern holding unit.

In the first interference-pattern holding unit 57, multiple interference patterns are set in advance, and the set interference patterns are held. FIG. 9A is one example of the interference patterns, and illustrates four interference patterns FP1 to FP4. Each of the interference patterns FP1 to FP4 includes four pieces of comparison data E(i), E(i−1), E(i−2), and E(i−3), and is compared with Dn(i), Dn(i−1), Dn(i−2), and Dn(i−3), respectively, in the first comparing unit 58. The number of interference patterns is not limited to this, of course.

Suppose the 2-bit image data Dn is data instructing 0: no ejection, 1: small droplet, 2: medium droplet, and 3: large droplet. In this case, for example, the interference pattern FP1 is a pattern that is detected when the value of the image data Dn(i−1) of the cycle right before is a value (1 to 3) other than 0, that is, when ejection has been performed. A sign "-" expresses "Don't Care", and means that it can be any kind of data, that is, no comparison is performed. A sign "#" expresses a value of image data of the concerned cycle, and means to compare an arbitrary value # with the interference pattern FP1 to judge matching. When the comparison data E(i) is 4-bit data, and the image data Dn(i) is a value that corresponds to either one of a bit with a value 1 out of respective bits (b3, b2, b1, b0) of the comparison data, it is judged as matching. That is, "≠0" is set to (1, 1, 1, 0), and when Dn is 3, 2, or 1, it is judged as matching. This operation is performed for each of the comparison data, and when all of pieces of the comparison data are matching, it is regarded to match with the interference pattern. Note that to the sign "-", (1, 1, 1, 1) are set.

The first comparing unit 58 compares the data history held in the data-history holding unit 56 with the respective interference patterns FP1 to FP4 held in the first interference-pattern holding unit 57, to judge matching. When matching with either one of the interference patterns, the first comparing unit 58 outputs a detection result indicating the interference pattern that matches with the value # of the concerned cycle. For example, when the data history is $$(Dn(i),Dn(i-1),Dn(i-2),Dn(i-3))=(3,2,0,1),$$

it matches with the interference pattern FP1, and therefore, a value 3 of the concerned cycle and an interference pattern number 1 are output. When matching with more than one pattern, determining in advance the priority orders (for example, prioritizing a younger pattern number), one having the higher priority is output as the detection result.

The first correction-data holding unit 53 holds correction data of driving waveforms that correspond to the respective detection results output by the first detecting unit 51, and selects one from among the held correction data according to the detection result, to output as temporal-interference correction data. For example, when FP1 is detected for #=3, correction data that is correction data of large-droplet driving-waveform data, and that corresponds to the interference pattern FP1 is output.

The second detecting unit 52 receives the image data Dn of the channel n and the image data Dn−1 and Dn+1 of the adjacent channels, and detects a spatial interference, and includes an adjacent-data holding unit 59, a second interference-pattern holding unit 60, and a second comparing unit 61.

In the adjacent-data holding unit 59, the image data Dn(i), Dn−1(i), Dn+1(i) of a corresponding cycle i in the channel and the adjacent channels are held.

In the second interference-pattern holding unit 60, multiple interference patterns are set in advance, and the set interference patterns are held. FIG. 9B is one example of the interference patterns, and six interference patterns XP1 to XP6 are illustrated. Each of the interference patterns includes three pieces of comparison data En−1, En−2, and En+1, and is compared with Dn−1(i), Dn(i), Dn+1(i), respectively, by the second comparing unit 61. The number of the interference patterns is not limited thereto, for course. For example, an interference pattern XP3 is a pattern that is detected when Dn−1(i) and Dn+1(i) of the adjacent channels are 0 and 2, respectively. Note that a pattern symmetric thereto is also judged as matching. That is, it is regarded as matching also when the image data Dn−1(i) and Dn+1(i) are 2 and 0, respectively.

Furthermore, the comparison data En is 4-bit data, and when the image data Dn(i) is a value that corresponds to either one of a bit with a value 1 out of respective bits (b3, b2, b1, b0) of the comparison data, it is judged as matching. Moreover, the interference pattern can be judged based on the number of channels in which ejection from the nozzle has been performed on each of the left side and the right side for image data out of the adjacent channels, that is, based on the number of channels, image data of which is other than 0.

The second comparing unit 61 compares the adjacent data held in the adjacent-data holding unit 59 with the interference patterns XP1 to XP6 held in the second interference-pattern holding unit 60, respectively, to judge matching. When it is matching with either one of the interference patterns, the second comparing unit 61 outputs a detection result indicating the interference pattern that matches with the value # of the cycle. For example, when the adjacent data is $$(Dn-1(i),Dn(i),Dn+1(i))=(0,3,2),$$

the adjacent data matches with the interference pattern XP3, and therefore, a value 3 of the cycle and an interference pattern number 3 are output. When matching with more than one pattern in this case also, determining in advance the priority orders, one having the higher priority is output as the detection result.

The second correction-data holding unit 54 holds pieces of correction data of driving waveforms that correspond to detection results to be output by the second detecting unit 52, and selects one from among the pieces of held correction data according to the detection result, to output the selected one as spatial-interference correction data. For example, when XP3 is detected for #=3, correction data that is correction data of large-droplet driving-waveform data and that corresponds to the interference pattern XP3 is output.

In the detection-result control unit 55, priority conditions of detection results to determine that one is valid and the other is invalid, or both are valid/invalid for detection results output from the first detecting unit 51 and the second detecting unit 52 are held. The detection-result control unit 55 changes each detection result according to the priority conditions, or outputs a valid/invalid signal. For example, suppose that detection results indicating that it matches with either one of the interference patterns are output from the first detecting unit 51 and the second detecting unit 52. In this case, if a priority condition that a detection result from the first detecting unit 51 is prioritized is set, the detection result from the first detecting unit 51 is processed to be valid and the detection result from the second detecting unit 52 is processed to be invalid. When processed to be valid, corresponding correction data is output from the correction-data holding unit, and when processed to be invalid, correction data is not output therefor. It can be determined that both are invalid, or both are valid. When both are determined to be valid, two pieces of correction data are output, and an addition value thereof is to be final correction data. Moreover, the priority conditions can be set for each combination of interference patterns of the first detection unit 51 and the second detecting unit 52.

Although it has been explained as an example in which both the temporal and the spatial interferences are corrected in the present embodiment; depending on the liquid ejection head 3 to be adopted or a liquid to be used, there is a case in which an influence of one of those is so small that it can be ignored. In such a case, only one of the interferences having a large influence can be corrected. That is, the driving-waveform correcting unit 38 can include the first detecting unit 51 and the first correction-data holding unit 53, or of the second detecting unit 52 and the second correction-data holding unit 54.

Figure 10:
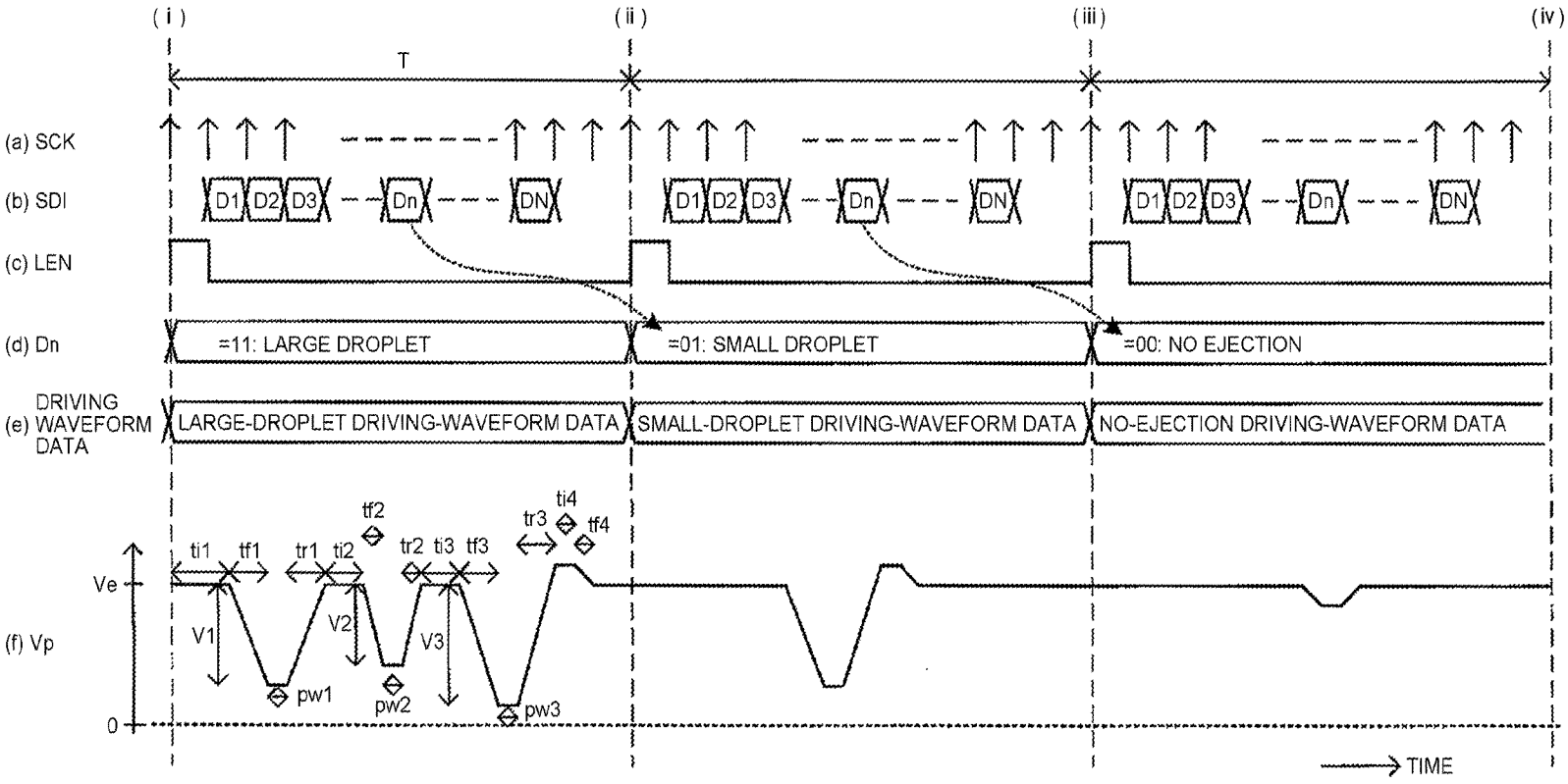
FIG. 10 is a timing chart of a main signal to explain operation of the head driving unit.

FIG. 10 is a timing chart of a main signal to explain operation of the head driving unit.

The liquid ejection heads 3 and 14 according to the present embodiment eject liquid in a predetermined print cycle T. The print cycle T is determined based on a conveying speed of the recording medium 10 and a print resolution in a conveying direction of each nozzle row.

In FIG. 10, (a) is a transfer clock SCK, and (b) is image data SDI. Synchronizing with the transfer clock SCK, the data SDI is serially input. The cycle of the transfer clock SCK is determined so that N pieces of image data that are ejected from N pieces of nozzles driven by this head driving unit 31 are transferred within one print cycle T. Although data is transferred sequentially from D1 in this example, it can be transferred in a reverse order.

In FIG. 10, (c) is the latch enable signal, and image data that has been transferred serially in the previous cycle is latched at a rise of LEN, and (d) is Dn indicating one of those, and D1 to DN are also latched the same timing.

In FIG. 10, at time (i), data transferred in a previous cycle (11 indicating ejection of a large droplet in this example), and at time (ii), data transferred in cycles (i) to (ii) (01 indication ejection of a small droplet in this example) are latched, respectively. Moreover, in the present embodiment, the latch enable signal LEN is also a start reference for generation of a driving waveform described later, and therefore, the cycle of LEN is the print cycle T. The signal indicating the start reference for generation of a driving waveform can be a signal input independently, or can be a signal generated by delaying LEN by a predetermined amount in consideration of reference time of driving waveform data or operation time to generate correction data.

In the following, explanation is given with an example of the driving-waveform generating unit 35-*n* to drive the piezoelectric member 112-*n* of the n-th channel, but other channels are also the same.

In FIG. 10, (e) is a part of driving waveform data that expresses data of a driving waveform that is generated by the driving-waveform generating unit 35-*n*, and (f) is a driving voltage Vp applied to the piezoelectric member 112-*n*. The driving voltage Vp is usually maintained at the reference potential Ve, and by charging and discharging the piezoelectric member 112-*n* by the driver included in the driving-waveform generating unit 35-*n*, the driving voltage Vp is displaced. Furthermore, when the driver is not active, the previous potential is maintained. Although it is self-discharged due to insulation resistance components on both ends of the piezoelectric member 112-*n*, it is an ignorable level.

The driving waveform-generating unit 35-*n* generates a driving waveform. For example, in a cycle from (i) to (ii), the driving waveform-generating unit 35-*n* generates a driving waveform for large droplet ejection. At the time of large droplet ejection, it drives with a driving waveform of three pulses in a row as illustrated. Furthermore, the value is determined so that droplets ejected at respective pulses coalesce into one droplet during flight, and a desired droplet amount is ejected on a desired landing position. That is, a pulse interval ti*, a pulse width pw*, a pulse wave high value V*, a fall time tf*, and a rise time tr* (where * is a numeral expressing the sequence) are determined. Moreover, it is necessary to control such that each value is the desired value. These are held in the driving-waveform-data holding unit 37 as the driving waveform data.

Furthermore, correction data to correct a driving waveform is generated by the driving-waveform correcting unit 38 so as to suppress a variation amount of the ejection characteristics (the ejection speed, the liquid droplet amount (for example, the ink droplet amount), the ejection stability, and the like) that vary affected by the temporal and the spatial interferences described above. This correction data is added to the driving waveform data to form a driving waveform of the channel of the cycle.

Figure 11:
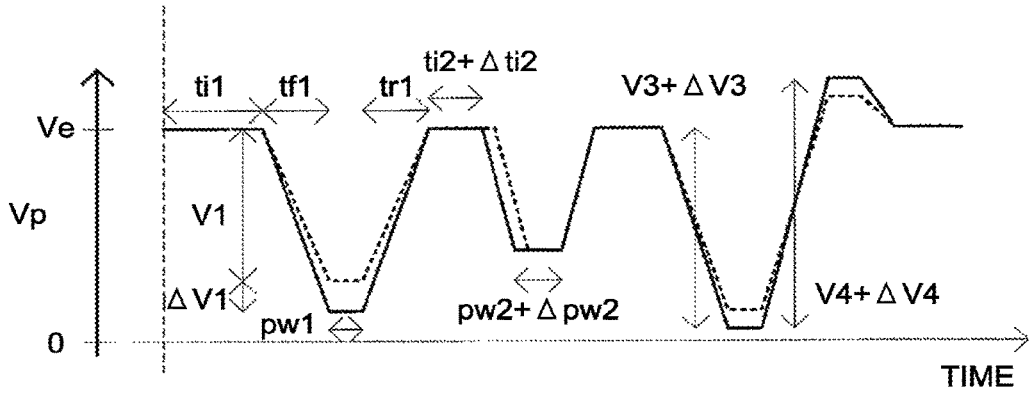
FIG. 11 illustrates one example of a driving waveform after correction data is added.

FIG. 11 illustrates one example of a driving waveform after correction data is added. In the drawing, correction date is assigned with a symbol Δ. By using the correction data with the symbol Δ; a driving waveform such as the pulse wave high value V, the pulse interval ti, and the pulse width pw is adjusted, and the influence of the temporal interference and the spatial interference is suppressed to control such that desired ejection characteristics are obtained. For example, by adjusting the pulse wave high value V, the pulse interval ti, or the pulse width pw of each pulse; variations in the ejection characteristics can be suppressed.

Because the ejection characteristics vary according to the liquid temperature (for example, ink temperature) of an ejected liquid, driving waveforms are prepared per liquid temperature, and data held in the driving-waveform holding unit is updated according to the liquid temperature. Alternatively, data of all temperature ranges is held in advance, and the ink temperature is informed by the controller 32 through the control unit 36, and the data to be referred to by each of the driving-waveform generating unit 35 is switched. Similarly, the correction data is also updated according to the liquid temperature.

In a cycle from (ii) to (iii) in FIG. 10, the driving waveform-generating unit 35-*n* generates a driving waveform for small droplet ejection. A driving waveform for a small droplet includes one pulse as illustrated. In this cycle, based on the value (=01) of the latched image data Dn, driving waveform data for a small droplet is referred to. The correction data is added to this to form a driving waveform data of this cycle, and thereafter, the driving waveform is generated similarly to the above.

In a cycle from (iii) to (iv) in FIG. 10, the latched image data Dn is no ejection (=00), generally, for the purpose of preventing drying of ink and clogging, vibrations at the level not causing a droplet to be ejected from the nozzle are given (this is called feeble driving, or shaking). For this also, driving waveform data for feeble driving is referred to, and the driving waveform is generated similarly. In the case of feeble driving, as ejection itself is not performed, there often is no influence even if correction data is not added. For such correction data with little influence, settings are made omitting the interference pattern and the correction data, so as to reduce the data amount to be held.

As for the driving waveform data, a driving waveform is designed so as to be compatible with the properties of a liquid (ink) to be used, at the time of design of the liquid ejection heads 3 and 14, and the image forming apparatus 1, and is stored in a program storage read-only memory (ROM) or a non-volatile memory of, for example, the controller 32 in the image forming apparatus 1. The data is then set in the driving-waveform data holding unit 37 at the time of start of the apparatus.

Similarly, the respective interference patterns, the correction data corresponding thereto, and the priority conditions for detection results are also determined in advance such that the ejection characteristics (the ejection speed, the liquid (ink) droplet amount, the ejection stability, and the like) substantially become desirable by experiments and the like, and are stored in the image forming apparatus 1. The values are set in the respective holding units through the control unit 36 at the start of the image forming apparatus 1.

Moreover, as the driving waveform data is changed when an apparatus-inside environment (temperature and the like), a print condition (print speed), and the like are changed, the respective interference patterns and the correction data and the priority conditions for detection results corresponding thereto are also updated together with the change, through the control unit 36.

Furthermore, when the driving waveform data is changed during a print operation, it is preferable that the corresponding correction data and the like be switched at the same time. For this, the holding unit of each data has at least two holding units that enable to hold the same data. During a print operation, it is arranged such that data held in one of the holding units is referred to, and new data is written in the other holding unit through the control unit. It is preferable to switch data to be referred all at once to that in the holding unit in which the new data has been written at the time when all new data has been written. Furthermore, by arranging to write coming new data into the holding unit in which old data is held, all of data can be updated to new data without suspending the print operation.

A liquid ejection apparatus according to the present embodiment is an apparatus that ejects liquid by driving the liquid ejection head. The liquid ejection apparatus includes the liquid ejection head or the liquid ejection unit, and is an apparatus that drives the liquid ejection head to eject liquid. The liquid ejection apparatus includes, not only an apparatus capable of ejecting liquid to a material on which the liquid can adhere, but also an apparatus that ejects liquid into atmosphere or fluid.

Moreover, the liquid ejection apparatus is a recording apparatus (printer) that is configured to form an image on a recording medium by ejecting liquid from the liquid ejection heads 3 and 14 as an image forming apparatus, in the present embodiment. In addition thereto, the liquid ejection apparatus can include a three-dimensional molding apparatus, a treatment-solution applying apparatus, and a jet granulating apparatus. The three-dimensional molding apparatus is an apparatus that ejects molding liquid onto a particle layer that is formed by layering powers, and is also called 3D molding apparatus.

Moreover, the liquid ejection apparatus is not limited to one that visualizes a significant image such as characters and drawings by ejected liquid. For example, one that forms a pattern and the like that has no meaning itself, one that molds a three-dimensional image are also included.

Note that the material on which liquid can adhere, described above, is one on which liquid can adhere at least temporarily, and signifies a material on which liquid adheres and is fixed, a material on which liquid adheres and then penetrates, and the like. As a specific example, a medium to be recorded such as a paper sheet, recording paper, a recording sheet, a film, and a cloth, an electronic part such as an electronic board, a piezoelectric element (piezoelectric member), a medium such as a powder layer (particle layer), an organ model, and a cell for examination, and includes all materials on which liquid adheres, unless otherwise specified. The material on which liquid can be paper, thread, fabric, textile, leather, metal, plastic, glass, wood, ceramics, and the like that enable liquid to adhere thereon even for a moment.

Furthermore, although the liquid ejection apparatus is an apparatus in which the liquid ejection heads 3 and 14, and a material on which liquid can adhere relatively move, it is not limited thereto. As a specific example, a serial apparatus (the second example) in which the liquid ejection head 14 is moved, a line apparatus (the first example) that does not move the liquid ejection head 3 can be included.

In addition, the liquid ejection apparatus can also be a treatment-solution applying apparatus that ejects treatment solution onto a paper sheet to apply the treatment solution on a surface of the paper sheet for the purpose of improving the quality of the surface of the paper sheet. Moreover, the liquid ejection apparatus can also be a jet granulating apparatus that granulates minute particles of a material by jetting a liquid composition in which the material is dispersed in a solution, and the like.

Furthermore, the liquid ejection apparatus can include a means relating to supply, conveyance, and ejection of a material on which liquid can adhere, a preprocessing device, a postprocessing device, and the like.

FIG. 12 illustrates a reference example of the liquid ejection head and a liquid ejection unit that replenishes liquid to the head. FIG. 12 corresponds to a drawing of the serial liquid ejection apparatus illustrated in FIG. 5 viewed from a side. The carriage 13 is equipped with the liquid ejection head 14 and the head tank 15, and the carriage 13 is supported by the guide rod 12 (the guide rod 11 is not illustrated) movably in a direction perpendicular to a paper surface. The head tank 15 is to provide liquid to be ejected, to the liquid ejection head 14, and in the present embodiment, for example, four colors Y, M, C, K of ink are respectively mounted in each of the liquid ejection head 14.

The carriage 13 is positioned above the recording medium 10 in FIG. 5, and the recording medium 10 is conveyed in a state of being sucked by a conveyance belt 18 illustrated in FIG. 12. The conveyance belt 18 is arranged under tension with a predetermined pressure between a conveyance roller 17*a* and a tension roller 17*b*, and the conveyance belt 18 and the recording medium 10 are conveyed as the conveyance roller 17*a* rotates. As a conveying mechanism and a moving mechanism for a carriage are publicly known techniques, explanation thereof is omitted.

According to the present embodiment, there are provided the multiple driving-waveform generating units 35-1 to 35-*n* respectively corresponding to the nozzles 104. Moreover, correction data of a driving waveform is generated according to a data history of the channel or data of the adjacent channels, so as to correct variations in the liquid droplet amount (for example, ink droplet amount) and the landing position due to an influence of interferences (for example, residual vibrations from previous ejection or crosstalk from an adjacent nozzle) occurred at ejection of any timing of the nozzle. The corresponding driving-waveform generating unit 35 generates a driving waveform adjusted according to the correction data. Thus, the liquid droplet amount (for example, ink droplet amount) ejected from each nozzle and the landing position become desired state, and degradation in the image quality can be suppressed.

Conventionally, a common driving-waveform method in which one common driving waveform having various driving waveform elements to eject various kinds of liquid droplets (ink droplets) combined is used, and a necessary part of waveform is selectively applied to respective piezoelectric members by a switching device has been adopted. In the present embodiment, unlike the conventional common driving-waveform method, a driving waveform to eject various kinds of liquid (ink droplets) can be set per liquid (ink droplet) type (for example, a large droplet a medium droplet, and a small droplet) to drive it. Therefore, it becomes possible to optimize a driving waveform for each of the liquid types (ink droplet types), and to set to further preferable ejection characteristics.

As explained above, according to the present embodiment, the following effects are obtained. In the following explanation, respective elements in claims and respective components in the present embodiment are associated with each other, and when different terms are used, the latter is described in parentheses.

(1) The head driving device 31 according to the present embodiment drives the liquid ejection heads 3 and 14 including the plurality of pressure generating devices 112 provided respectively corresponding to the multiple nozzles 104. The head driving device 31 includes the driving-waveform correcting unit (driving-waveform correcting unit 38) configured to correct driving waveform data that defines ejection characteristics of liquid to be ejected from the nozzle 104 based on the interference patterns FP1 to FP4, Xp1 to XP6 expressing variations in the ejection characteristics caused by interferences occurring in the nozzle 104 in the head driving device (the head driving unit 31). Therefore, changes in a droplet amount and/or a landing position of ejected liquid caused by an influence of the temporal interference and/or the spatial interference can be corrected accurately, and the degradation in the image quality can be suppressed.

(2) In the head driving device according to (1), the driving-waveform correcting unit (the driving-waveform correcting unit 38) includes: an ejection-history holding unit (the data-history holding unit 56) configured to hold the ejection history of the nozzle 104; the first interference-pattern holding unit 57 configured to hold the interference patterns FP1 to FP4; the first comparing unit 58 configured to compare the ejection history and each of the interference patterns FP1 to FP4, and output a comparison result indicating whether the ejection history and any of the interference patterns FP1 to FP4 match with each other; and the first correction-data holding unit 53 configured to hold pieces of driving-waveform correction data to correct driving waveforms, the pieces of driving-waveform correction data respectively corresponding to the interference patterns FP1 to FP4, and select and output a piece of driving-waveform correction data according to the comparison result. The interference patterns FP1 to FP4 are patterns based on the ejection history of the nozzle 104 that causes an influence of the temporal interference. Therefore, changes in a droplet amount and/or a landing position of ejected liquid caused by an influence of the temporal interference can be corrected accurately, and the degradation of the image quality can be suppressed. The interference patterns and the correction data held associated with the interference patterns can be just one, not multiple, and even in such a case, it is expressed as "select correction data".

(3) In the driving device according to (1), the driving-waveform correcting unit (the driving-waveform correcting unit 38) includes: the adjacent-data holding unit 59 configured to hold adjacent data indicating an ejection condition of the multiple nozzles 104 adjacent to the concerned nozzle 104; the second interference-pattern holding unit 60 configured to hold the interference patterns XP1 to XP6; the second comparing unit 61 configured to compare the adjacent data and each of the interference patterns XP1 to XP6, and output a comparison result indicating whether the adjacent data and any of the interference patterns XP1 to XP6 match with each other; and the second correction-data holding unit 54 configured to hold pieces of driving-waveform correction data to correct driving waveforms, the pieces of driving-waveform correction data respectively corresponding to the interference patterns XP1 to XP6, and select and output a piece of driving-waveform correction data according to the comparison result. The interference patterns XP1 to XP6 are patterns indicating the ejection condition of the adjacent nozzle 104 that causes an influence of the spatial interference. Therefore, changes in a droplet amount and/or a landing position of ejected liquid caused by the influence of the temporal interference can be corrected accurately, and the degradation of the image quality can be suppressed.

(4) In the head driving device according to (1), the driving-waveform correcting unit (the driving-waveform correcting unit 38) includes an ejection-history holding unit (the data-history holding unit 56) configured to hold an ejection history of the nozzle 104; the first interference-pattern holding unit 57 configured to hold the first interference patterns FP1 to FP4; the first comparing unit 58 configured to compare the ejection history and each of the first interference patterns FP1 to FP4, and output a comparison result indicating which one of the interference patterns matches with the ejection history; the first correction-data holding unit 53 configured to hold pieces of driving-waveform correction data to correct driving waveforms, the pieces of driving-waveform correction data respectively corresponding to the first interference patterns FP1 to FP4, and select and output a piece of driving-waveform correction data according to the comparison result; the adjacent-data holding unit 59 configured to hold adjacent data indicating an ejection condition of the multiple nozzles 104 adjacent to the corresponding nozzle 104; the second interference-pattern holding unit 60 configured to hold the second interference patterns XP1 to XP6; the second comparing unit 61 configured to compare the adjacent data and each of the interference patterns XP1 to XP6, and output a comparison result indicating which one of the interference patterns matches with the adjacent data; and the second correction-data holding unit 54 configured to hold pieces of driving-waveform correction data to correct driving waveforms, the pieces of correction data respectively corresponding to the second interference patterns XP1 to XP6, and select and output a piece of driving-waveform correction data according to the comparison result. The first interference patterns FP1 to FP4 are patterns indicating the ejection history that causes an influence of the temporal interference, and the second interference patterns XP1 to XP6 are patterns indicating an ejection condition of the adjacent nozzle 104 that causes an influence of the spatial interference. Therefore, changes in a droplet amount and/or a landing position of ejected liquid caused by the influence of the temporal interference and the spatial interference can be corrected accurately, and the degradation of the image quality can be suppressed.

(5) In the head driving device according to (4), the driving-waveform correcting unit (the driving-waveform correcting unit 38) includes a comparison-result control unit (the detection-result control unit 55) configured to determine whether the comparison results of the first comparing unit 58 and the second comparing unit 61 are valid or invalid according to priority conditions set in advance. For the comparison result determined as invalid, corresponding correction data is not output, and therefore, whether temporal-interference correction data is prioritized or spatial-interference correction data is prioritized is set based on the priority conditions set in advance, correction of changes in a droplet amount and/or a landing position of ejected liquid based on the prioritized interference correction data can be performed.

(6) In the head driving device (31) according to any one of (2) to (5), the driving waveform data is a plurality of pieces of driving waveform data according to the size of a liquid droplet, and the correction data is set according to the size of the liquid droplet to be ejected. The interference patterns FP1 to FP4, XP1 to XP6 are patterns including information about the size of a liquid droplet to be ejected, and the driving-waveform correcting unit (the driving-waveform correcting unit 38) corrects the driving waveform data by referring to the driving waveform data that is selected from among the plurality of pieces of driving waveform data according to the size of a liquid droplet ejected by the nozzle 104 and the correction data. Therefore, correction of the driving waveform data corresponding to the size of a liquid droplet can be performed.

(7) In the head driving device according to any one of (2) to (6), an updating unit (the control unit 36) configured to update the driving waveform data, the interference patterns, and the correction data synchronizing with each other is provided. Therefore, these data are updated in synchronization with each other. As a result, all of the data can be updated without suspending an ejection operation of liquid.

(8) The liquid ejection head unit 39 includes: the head driving device 31 according to any one of (1) to (7); and the liquid-droplet ejection head 3 and 14 that are driven by the head driving device 31. Therefore, the effects described in (1) to (7) above can be obtained by driving the liquid-droplet ejection head.

(9) The liquid ejection apparatus (the image forming apparatus 1) includes the head driving device according to any one of (1) to (7). Therefore, the liquid ejection apparatus can produce the effects described in (1) to (7) above.

(10) The liquid ejection apparatus includes the liquid-ejection head unit 39. Therefore, the liquid ejection apparatus can produce the effects described in (1) to (7).

According to one aspect of the present invention, variations in a droplet amount and/or a landing position of ejected liquid caused by an influence of a temporal interference and a spatial interference can be corrected with high accuracy, and can suppress degradation of an image quality.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A head driving device that drives a liquid ejection head, the liquid ejection head including a plurality of nozzles and a plurality of pressure generating devices provided respectively corresponding to the nozzles, the head driving device comprising:

a plurality of driving-waveform correcting units provided respectively corresponding to the pressure generating devices, each of the plurality of driving-waveform correcting units being configured to correct driving waveform data that defines ejection characteristics of liquid to be ejected from the corresponding nozzle based on interference patterns expressing variations in the ejection characteristics caused by an interference occurring in the nozzle.

2. The head driving device according to claim 1, wherein one of the driving-waveform correcting units that corresponds to a particular nozzle includes an ejection-history holding unit configured to hold an ejection history of the particular nozzle;

an interference-pattern holding unit configured to hold the interference patterns in association with the particular nozzle;

a comparing unit configured to compare the ejection history and each of the interference patterns, and output a comparison result indicating whether the ejection history and any of the interference patterns match with each other; and a correction-data holding unit configured to hold pieces of correction data to correct driving waveforms for the particular nozzle, the pieces of correction data respectively corresponding to the interference patterns, and select and output a piece of correction data for the particular nozzle according to the comparison result, and each of the interference patterns in association with the particular nozzle is a pattern based on the ejection history of the particular nozzle that causes an influence of a temporal interference.

3. The head driving device according to claim 2, wherein the driving waveform data for the particular nozzle includes a plurality of pieces of driving waveform data according to a size of a liquid droplet to be ejected, the piece of correction data for the particular nozzle is set according to the size of the liquid droplet to be ejected, each of the interference patterns in association with the particular nozzle is a pattern including information about the size of the liquid droplet to be ejected, and the one of the driving-waveform correcting units refers to the driving waveform data that has been selected from among the plurality of pieces of the driving waveform data according to the size of the liquid droplet to be ejected by the particular nozzle and according to the piece of correction data, to correct the driving waveform data.

4. The head driving device according to claim 2, further comprising:

an updating unit configured to update the driving waveform data, the interference patterns, and the pieces of correction data in association with the particular nozzle in synchronization with each other.

5. The head driving device according to claim 1, wherein one of the driving-waveform correcting units that corresponds to a particular nozzle includes an adjacent-data holding unit configured to hold adjacent data of the particular nozzle indicating an ejection condition of a nozzle adjacent to the particular nozzle;

an interference-pattern holding unit configured to hold a plurality of interference patterns in association with the particular nozzle;

a comparing unit configured to compare the adjacent data and each of the interference patterns, and output a comparison result indicating whether the adjacent data and any the interference pattern match with each other; and a correction-data holding unit configured to hold pieces of correction data to correct driving waveforms for the particular nozzle, the pieces of correction data respectively corresponding to the interference patterns, and select and output a piece of correction data for the particular nozzle according to the comparison result, and each of the interference patterns in association with the particular nozzle is a pattern that indicates an ejection condition of a corresponding nozzle adjacent to the particular nozzle that causes an influence of a spatial interference.

6. The head driving device according to claim 5, wherein the driving waveform data for the particular nozzle includes a plurality of pieces of driving waveform data according to a size of a liquid droplet to be ejected, the piece of correction data for the particular nozzle is set according to the size of the liquid droplet to be ejected, each of the interference patterns in association with the particular nozzle is a pattern including information about the size of the liquid droplet to be ejected, and the one of the driving-waveform correcting units refers to the driving waveform data that has been selected from among the plurality of pieces of the driving waveform data according to the size of the liquid droplet to be ejected by the particular nozzle and according to the piece of correction data, to correct the driving waveform data.

7. The head driving device according to claim 5, further comprising:

an updating unit configured to update the driving waveform data, the interference patterns, and the pieces of correction data in association with the particular nozzle in synchronization with each other.

8. The head driving device according to claim 1, wherein one of the driving-waveform correcting units that corresponds to a particular nozzle includes an ejection-history holding unit configured to hold an ejection history of the particular nozzle;

a first interference-pattern holding unit configured to hold a plurality of first interference patterns in association with the particular nozzle;

a first comparing unit configured to compare the ejection history and each of the first interference patterns, and output a first comparison result indicating which one of the first interference pattern matches with the ejection history;

a first correction-data holding unit configured to hold pieces of first correction data to correct driving waveforms for the particular nozzle, the pieces of first correction data respectively corresponding to the first interference patterns, and select and output a piece of first correction data for the particular nozzle according to the first comparison result;

an adjacent-data holding unit configured to hold adjacent data of the particular nozzle indicating an ejection condition of a nozzle adjacent to the particular nozzle;

a second interference-pattern holding unit configured to hold a plurality of second interference patterns in association with the particular nozzle;

a second comparing unit configured to compare the adjacent data and each of the second interference patterns, and output a second comparison result indicating which one of the second interference patterns matches with the adjacent data; and a second correction-data holding unit configured to hold pieces of second correction data to correct driving waveforms for the particular nozzle, the pieces of second correction data respectively corresponding to the second interference patterns, and select and output a piece of second correction data for the particular nozzle according to the second comparison result, each of the first interference patterns in association with the particular nozzle is a pattern that indicates an ejection history of the particular nozzle that causes an influence of a temporal interference, and each of the second interference patterns in association with the particular nozzle is a pattern that indicates an ejection condition of a corresponding nozzle adjacent to the particular nozzle that causes an influence of a spatial interference.

9. The head driving device according to claim 8, wherein the one of the driving-waveform correcting units includes a comparison-result control unit configured to determine whether comparison results of the first comparing unit and the second comparing unit are valid or invalid, and not to output, for a comparison result determined as invalid, a piece of correction data corresponding thereto.

10. The head driving device according to claim 8, wherein the driving waveform data for the particular nozzle includes a plurality of pieces of driving waveform data according to a size of a liquid droplet to be ejected, the pieces of first correction data and the piece of second correction data are set according to the size of the liquid droplet to be ejected, each of the first interference patterns in association with the particular nozzle and each of the second interference patterns in association with the particular nozzle are patterns including information about the size of the liquid droplet to be ejected, and the one of the driving-waveform correcting units refers to the driving waveform data that has been selected from among the plurality of pieces of the driving waveform data according to the size of the liquid droplet to be ejected by the particular nozzle and according to the first and second pieces of correction data, to correct the driving waveform data.

11. The head driving device according to claim 8, further comprising:

an updating unit configured to update the driving waveform data, the interference patterns, and pieces of correction data in association with the particular nozzle in synchronization with each other.

12. A liquid-ejection head unit comprising:

the head driving device according to claim 1; and a liquid-droplet ejection head that is driven by the head driving device.

13. A liquid ejection apparatus comprising:

the liquid-ejection head unit according to claim 12.

14. A liquid ejection apparatus comprising:

the head driving device according to claim 1.

* * * * *